United States Patent [19]

Sato et al.

[11] 4,179,296

[45] Dec. 18, 1979

[54] SILVER HALIDE PHOTOGRAPHIC EMULSION

[75] Inventors: Akira Sato; Atsuo Iwamoto; Takeo Sakai; Haruo Takei, all of Minami-ashigara, Japan

[73] Assignee: Fuji Photo Film Co., Ltd., Minami-ashigara, Japan

[21] Appl. No.: 860,919

[22] Filed: Dec. 15, 1977

Related U.S. Application Data

[63] Continuation-in-part of Ser. No. 751,833, Dec. 17, 1976, abandoned.

[30] Foreign Application Priority Data

Dec. 29, 1975 [JP] Japan ..... 50/159261

[51] Int. Cl.$^2$ ..... G03C 1/14; G03C 1/18; G03C 1/19

[52] U.S. Cl. ..... 430/574; 430/588

[58] Field of Search ..... 96/124, 137, 100, 55, 96/63, 132, 134, 136, 138

[56] References Cited

U.S. PATENT DOCUMENTS

| | | | |
|---|---|---|---|
| 2,973,264 | 2/1961 | Nys et al. | 96/124 |
| 3,623,883 | 11/1971 | Bannert et al. | 96/137 |
| 3,764,340 | 10/1973 | Shiba et al. | 96/137 |
| 3,840,373 | 10/1974 | Shiba et al. | 96/124 |
| 3,840,376 | 10/1974 | Shiba et al. | 96/124 |
| 3,856,532 | 12/1974 | Thurston et al. | 96/124 |
| 3,873,324 | 3/1975 | Hinata et al. | 96/124 |
| 3,923,517 | 12/1975 | Yamamoto et al. | 96/124 |
| 3,966,477 | 6/1976 | Hinata et al. | 96/124 |

*Primary Examiner*—Richard L. Schilling
*Attorney, Agent, or Firm*—Sughrue, Rothwell, Mion, Zinn and Macpeak

[57] ABSTRACT

A silver halide photographic emulsion containing, in supersensitizing amounts, a combination of at least one benzimidazolocarbocyanine dye wherein an aralkyl group substituted with an acidic group is connected to at least one nitrogen atom in the imidazole ring, which is represented by the following general formula (I):

(I)

wherein $V_1$, $V_2$, $V_3$ and $V_4$, which may be the same or different, each represents a hydrogen atom, a halogen atom, an alkyl group, an alkenyl group, a cycloalkyl group, an acyl group, an acyloxy group, an alkoxycarbonyl group, a carbamoyl group, a sulfamoyl group, a cyano group, a trifluoromethyl group or a hydroxy group; $R_1$, $R_2$ and $R_3$, which may be the same or different, each represents an aliphatic group; A represents a sulfo group of a carboxy group; $X_1$ represents an acid residue; h represents an integer from 1 to 6; and i represents 0 or 1; and at least one cyanine dye represented by the following general formula (II):

(II)

wherein $Z_1$ represents the atoms necessary to complete a thiazole ring or a selenazole ring; $Z_2$ represents the atoms necessary to complete a thiazole ring, a selenazole ring or an oxazole ring; $R_4$ represents a hydrogen atom, an aliphatic group or an aryl group; $R_5$ and $R_6$, which may be the same or different, each represents an aliphatic group; $X_2$ represents an acid residue; and l and n each represents 0 or 1; which demonstrates reduced fog, reduced residual color and high sensitivity, and, further, which is endowed with desirable spectral sensitization distribution and minimized deterioration with the lapse of time under high temperature and humidity conditions.

7 Claims, No Drawings

SILVER HALIDE PHOTOGRAPHIC EMULSION

CROSS REFERENCE TO RELATED APPLICATIONS

This application is a continuation-in-part application of copending application, Ser. No. 751,833, filed Dec. 17, 1976, now abandoned.

BACKGROUND OF THE INVENTION

1. Field of the Invention

The present invention relates to a silver halide photographic emulsion which is spectrally sensitized with a supersensitizing combination of at least two kinds of sensitizing dyes.

2. Description of the Prior Art

Certain cyanine dyes are well known to increase very effectively the sensitivity of a silver halide photographic emulsion.

In such a case, high sensitivity in a longer wavelength region than the spectrally sensitive wavelength region inherent to the silver halide can be additionally imparted to a silver halide photographic emulsion by adsorption of cyanine dyes added thereto on the silver halide particles contained in the silver halide photographic emulsion. On the other hand, it is known that a certain second dye or other organic compounds, peculiarly selected with respect to the cyanine dye which was added first to the silver halide photographic emulsion, may markedly increase the efficiency of dye sensitization and, particularly, specific combinations of certain dyes provide high sensitivity to such an extent that more sensitivity than that attributed to the respective dyes is achieved. This effect is called as "supersensitization". Since no increase or decrease in the efficiency of sensitization has been conventionally experienced in the combined use of two or more dyes, supersensitization is said to be a superior effect.

Some combinations of sensitizing dyes showing supersensitization have been reported with the intention of increasing the sensitivity of a silver halide photographic emulsion. However, many of these known supersensitizing combinations are inadequate for silver halide color photographic sensitive materials because they reduce the sensitivity, cannot provide a suitable spectral sensitization distribution, cause fog and residual color, decrease the photosensitive property in the presence of other additives, or further affect adversely the stability properties after emulsion-coating. The improvement upon the deterioration with the lapse of time under high temperature and humidity conditions, i.e., an increase in fog, a decrease in sensitivity or the like, has been one of the important subjects in the art of sensitization.

SUMMARY OF THE INVENTION

Therefore, an object of the present invention is to provide a silver halide photographic emulsion which demonstrates reduced fog, reduced residual color and high sensitivity, and that which can provide a desirable spectral sensitization distribution.

Another object of the present invention is to provide a silver halide photographic emulsion which exhibits excellent stability, that is to say, minimization of the deterioration with the lapse of time under high temperature and humidity conditions.

The above-described objects are attained with a silver halide photographic emulsion containing, in supersensitizing amounts, a combination of a certain benzimidazolocarbocyanine dye and a certain cyanine dye.

Accordingly, this invention provides a silver halide photographic emulsion containing, in supersensitizing amounts, a combination of at least one benzimidazolocarbocyanine dye wherein an aralkyl group substituted with an acidic group is connected to at least one nitrogen atom in the imidazole ring, which is represented by the following general formula (I):

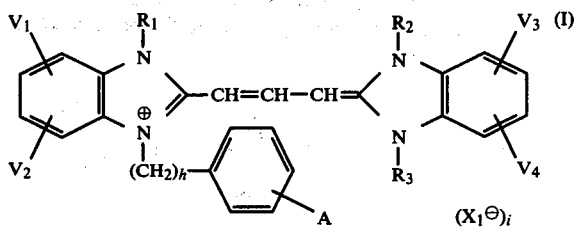

wherein $V_1$, $V_2$, $V_3$ and $V_4$, which may be the same or different, each represents a hydrogen atom, a halogen atom, an alkyl group, an alkenyl group, a cycloalkyl group, an acyl group, an acyloxy group, an alkoxycarbonyl group, a carbamoyl group, a sulfamoyl group, a cyano group, a trifluoromethyl group or a hydroxy group; $R_1$, $R_2$ and $R_3$, which may be the same or different, each represents an aliphatic group; A represents a sulfo group or a carboxy group; $X_1$ represents an acid residue; h represents an integer from 1 to 6; and i represents 0 or 1; and at least one cyanine dye represented by the following general formula (II):

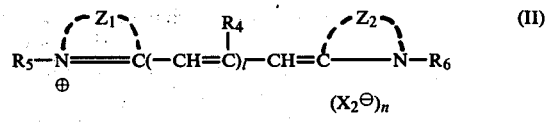

wherein $Z_1$ represents the atoms necessary to complete a thiazole ring or a selenazole ring; $Z_2$ represents the atoms necessary to complete a thiazole ring, a selenazole ring or an oxazole ring; $R_4$ represents a hydrogen atom, an aliphatic group or an aryl group; $R_5$ and $R_6$, which may be the same or different, each represents an aliphatic group; $X_2$ represents an acid residue; and l and n each represents 0 or 1.

DETAILED DESCRIPTION OF THE INVENTION

As sensitizing dyes which are indispensable for the present invention, the combination of at least one sensitizing dye represented by the following general formula (I):

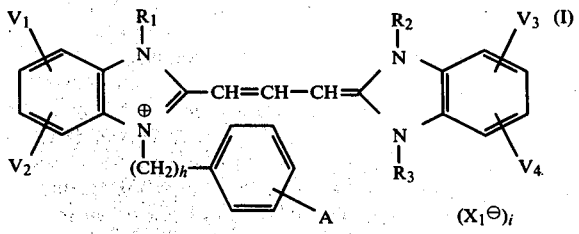

wherein $V_1$, $V_2$, $V_3$ and $V_4$, which may be the same or different, each represents a hydrogen atom, a halogen atom, an alkyl group, an alkenyl group, a cycloalkyl group, an acyl group, an acyloxy group, an alkoxycarbonyl group, a carbamoyl group, a sulfamoyl group, a cyano group, a trifluoromethyl group or a hydroxy group; $R_1$, $R_2$ and $R_3$, which may be the same or different, each represents an aliphatic group (e.g., an alkyl group and a substituted alkyl group); A represents a sulfo group or a carboxy group; $X_1$ represents an acid residue; h represents an integer from 1 to 6 (and preferably from 1 to 4); and represents 0 or 1; and at least one cyanine dye represented by the following general formula (II):

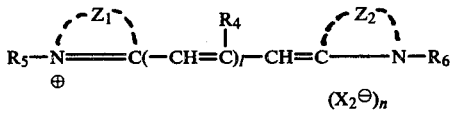

(II)

wherein $Z_1$ represents the atoms necessary to complete a thiazole ring or a selenazole ring; $Z_2$ represents the atoms necessary to complete a thiazole ring, a selenazole ring or an oxazole ring; $R_4$ represents a hydrogen atom, an aliphatic group or an aryl group; $R_5$ and $R_6$, which may be the same or different, each represents an aliphatic group; $X_2$ represents an acid residue; and l and n each represents 0 or 1.

Incidentally, the respective actual structures of the sensitizing dyes indispensable for the present invention are visualized as a resonance hybrid between two extremes, i.e., the general formula (I) or the general formula (II) and the structure wherein a plus charge is located on the nitrogen atom in the heterocyclic nucleus depicted at the right hand side in the general formula (I) or the general formula (II), respectively.

Each of preferred substituents in the general formulae (I) and (II) representing the sensitizing dyes employed in the practice of the present invention is defined below.

$V_1$, $V_2$, $V_3$ and $V_4$ each represents a hydrogen atom, a halogen atom (e.g., chlorine, fluorine, bromine and like atoms), an alkyl group containing 6 or less carbon atoms (e.g., methyl, ethyl and like groups), an alkenyl group containing 6 or less carbon atoms (e.g., allyl and like groups), a cycloalkyl group containing 6 or less carbon atoms (e.g., cyclohexyl and like groups), an acyl group containing 8 or less carbon atoms (e.g., acetyl, benzoyl, mesyl and like groups), an acyloxy group containing 3 or less carbon atoms (e.g., acetoxy and like groups), an alkoxycarbonyl group containing 8 or less carbon atoms (e.g., methoxycarbonyl, ethoxycarbonyl, benzyloxycarbonyl and like groups), a carbamoyl group (e.g., a carbamoyl group, an N,N-dimethylcarbamoyl group, a morpholinocarbonyl group, a piperidinocarbonyl group and like groups), a sulfamoyl group (e.g., sulfamoyl, N,N-dimethylsulfamoyl, morpholinosulfonyl, piperidinosulfonyl and like groups), a cyano group, a trifluoromethyl group or a hydroxy group.

$R_1$, $R_2$, $R_3$, $R_5$ and $R_6$ each represents an alkyl group containing 6 or less carbon atoms (e.g., methyl, ethyl and like groups), an alkenyl group containing 6 or less carbon atoms (e.g., allyl and like groups), a cycloalkyl group containing 6 or less carbon atoms (e.g., cyclohexyl and like groups), or a substituted alkyl group (e.g., alkyl groups containing 6 or less carbon atoms which can be substituted with one or more of a carboxy group, a sulfo group, a halogen atom (e.g., a fluorine atom, a chlorine atom, a bromine atom or the like), a hydroxy group, an alkoxycarbonyl group containing 8 or less carbon atoms (e.g., a methoxycarbonyl group, an ethoxycarbonyl group, a benzyloxycarbonyl group or the like), an alkoxy group containing 7 or less carbon atoms (e.g., a methoxy group, an ethoxy group, a benzyloxy group or the like), a monocyclic aryloxy group (e.g., a phenoxy group, a p-tolyloxy group or the like), an acyloxy group containing 3 or less carbon atoms (e.g., an acetyloxy group, a propionyloxy group or the like), an acyl group containing 8 or less carbon atoms (e.g., an acetyl group, a propionyl group, a benzoyl group, a mesyl group or the like), a carbamoyl group (e.g., a carbamoyl group, an N,N-dimethylcarbamoyl group, a morpholinocarbonyl group, a piperidinocarbonyl group or the like), a sulfamoyl group (e.g., a sulfamoyl group, an N,N-dimethylsulfamoyl group, a morpholinosulfonyl group, a piperidinosulfonyl group or the like), an aryl group, which may be mono- or bicyclic (e.g., a phenyl group, a p-hydroxyphenyl group, a p-carboxyphenyl group, a p-sulfophenyl group, an α-naphthyl group or the like) and so on).

$R_4$ represents a hydrogen atom, an alkyl group containing 6 or less carbon atoms (e.g., methyl, ethyl, propyl, cyclohexyl or the like), an aryl group, either mono- or bicyclic (e.g., phenyl, α-naphthyl, o-carboxyphenyl or the like) or an aralkyl group (e.g., benzyl, phenethyl or the like).

$Z_1$ represents the atoms necessary to complete a thiazole ring or a selenazole ring; and $Z_2$ represents the atoms necessary to complete a thiazole ring, a selenazole ring or an oxazole ring, wherein a heterocyclic nucleus or/and a benzene nucleus contained in these heterocyclic rings may be substituted with one or more substituents such as an alkyl group containing 6 or less carbon atoms (e.g., methyl, ethyl and so on), an alkenyl group containing 6 or less carbon atoms (e.g., allyl and so on), a cycloalkyl group containing 6 or less carbon atoms (e.g., cyclohexyl and so on), an aryl group, which may be mono- or bicyclic (e.g., phenyl, p-hydroxyphenyl, p-carboxyphenyl, p-sulfophenyl, α-naphthyl or the like), a hydroxy group, an alkoxy group containing 7 or less carbon atoms (e.g., methoxy, ethoxy, benzyloxy or the like), an acyl group containing 8 or less carbon atoms (e.g., acetyl, propionyl, benzoyl, mesyl or the like), a carboxy group, an alkoxycarbonyl group containing 8 or less carbon atoms (e.g., methoxycarbonyl, ethoxycarbonyl, benzyloxycarbonyl or the like), a halogen atom (e.g., fluorine, chlorine, bromine or the like) and so on. Specific examples of these substituents include the abovedescribed groups.

Specific examples of heterocyclic rings formed by each of $Z_1$ and $Z_2$ include the following rings: thiazoles nuclei (e.g., thiazole, 4-methylthiazole, 4-phenylthiazole, 4-(p-hydroxyphenyl)thiazole, 5-methylthiazole, 5-phenylthiazole, 4,5-dimethylthiazole, 4,5-diphenylthiazole, etc.), benzothiazole nuclei (e.g., benzothiazole, 5-hydroxybenzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5,6-dimethylbenzothiazole, 5-fluorobenzothiazole, 6-fluorobenzothiazole, 5-bromobenzothiazole, 6-bromobenzothiazole, 5-phenylbenzothiazole, 6-phenylbenzothiazole, 7-phenylbenzothiazole, 4-methoxybenzothiazole, 5-methoxybenzothiazole, 6-methoxybenzothiazole, 7-methoxybenzothiazole, 5-iodobenzothiazole, 6-iodobenzothiazole, 5-ethoxybenzothiazole, 6-ethoxybenzothiazole, 5-ethoxycarbonylbenzothiazole, tetrahydrobenzothiazole, 5-(N,N-dimethylcarbamoyl)benzothiazole, 5,6-dimethoxybenzothiazole, 5-hydroxybenzothiazole, 6-hydroxybenzothiazole, 5-acetylbenzothiazole, 5-benzoylbenzothiazole, 5-mesylbenzothiazole, 5-morpholinosulfonylbenzothiazole, 6-ethoxy-5-methylbenzothiazole, 5-phenoxybenzothiazole, 5-phenethylbenzothiazole, 5-cyanobenzothiazole, 5-trifluoromethylbenzothiazole, 6-trifluoromethylbenzothiazole, etc.), naphthothiazole nuclei (e.g., α-naphthothiazole, β-naphthothiazole, β,β-naphthothiazole, 5-methoxy-β-naphthothiazole, 5-ethoxy-β-naphthothiazole, 7-methoxy-α-naphthothiazole, 8-methoxy-α-naphthothiazole, 5-hydroxy-β-naphthothiazole, 7-hydroxy-α-naphthothiazole, 5-ethyl-β-naphthothiazole, 8,9-dihydro-β-naphthothiazole, 4,5-dihydro-α-naphthothiazole, etc.), oxazole nuclei (e.g., oxazole, 4-methyloxazole, 5-methyloxazole, 4-phenyloxazole, 4,5-diphenyloxazole, 4-ethyloxazole, 4,5-dimethyloxazole, 5-phenyloxazole, etc.), benzoxazole nuclei (e.g., benzoxazole, 5-chlorobenzoxazole, 5-methylbenzoxazole, 5-phenylbenzoxazole, 6-methylbenzoxazole, 4,6-dimethylbenzoxazole, 5,6-dimethylbenzoxazole, 5-methoxycarbonylbenzoxazole, 5-methoxybenzoxazole, 6-methoxybenzoxazole, 5-ethoxybenzoxazole, 5-phenethylbenzoxazole, 5-bromobenzoxazole, 5-phenoxybenzoxazole, 5-acetylbenzoxazole, 5-methyl-6-chlorobenzoxazole, 5-cyanobenzoxazole, 5-trifluoromethylbenzoxazole, 5-hydroxybenzoxazole, 6-hydroxybenzoxazole, etc.), naphthoxazole nuclei (e.g., α-naphthoxazole, β,β-naphthoxazole, β-naphthoxazole, 7-hydroxy-β-naphthoxazole, etc.), selenazole nuclei (e.g., selenazole, 4-methylselenazole, 4-phenylselenazole, etc.), benzoselenazole nuclei (e.g., benzoselenazole, 5-chlorobenzoselenazole, 5-methylbenzoselenazole, 5-methoxybenzoselenazole, 5-hydroxybenzoselenazole, tetrahydrobenzoselenazole, etc.) and naphthoselenazole nuclei (e.g., α-naphthoselenazole, β,β-naphthoselenazole, β-naphthoselenazole, etc.).

Specific examples of acid anions represented by $X_1\ominus$ and $X_2\ominus$ include a chlorine ion, a bromine ion, an iodine ion, a p-toluenesulfonc acid ion, a benzenesulfonic acid ion, a sulfuric acid ion, a perchloric acid ion, a thiocyanate ion and so on. i and n each represents 0 or 1, and when either equals 0, the dye forms an intramolecular salt.

The sensitizing dyes which can be used to advantage in the practice of the present invention, which are included in the above-described general formula (I), have the following general formula (I-A):

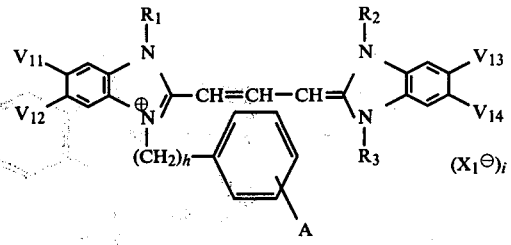

(I-A)

wherein $V_{11}$, $V_{12}$, $V_{13}$ and $V_{14}$ each has the same meaning as $V_1$, $V_2$, $V_3$ and $V_4$ in the above-described general formula (I), wherein at least one of them represents a halogen atom (e.g., fluorine, chlorine or the like), and $R_1$, $R_2$, $R_3$, A, $X_1$, h and i each has the same meaning as in the above-described general formula (I).

The sensitizing dyes which can be very useful and preferred in the present invention and which are included in the above-described general formula (I) or (II) have the respective following general formula (I-B) or (II-A).

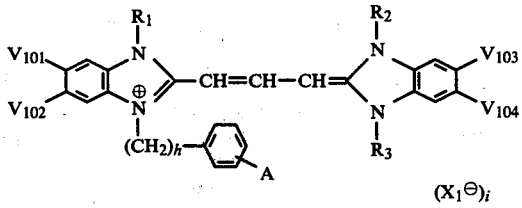

(I-B)

wherein, although $V_{101}$, $V_{102}$, $V_{103}$ and $V_{104}$ each has the same meaning as $V_1$, $V_2$, $V_3$ and $V_4$, respectively, in the abovedescribed general formula (I), $V_{101}$ and $V_{102}$, or/and $V_{103}$ and $V_{104}$ represent simultaneously a chlorine atom; and $R_1$, $R_2$, $R_3$, A, $X_1$, h and i each has the same meaning as in the above-described general formula (I);

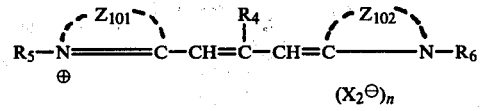

(II-A)

wherein $Z_{101}$ represents the atoms necessary to complete a benzothiazole nucleus or a benzoselenazole nucleus; $Z_{102}$ represents the atoms necessary to complete a benzothiazole nucleus, a benzoselenazole nucleus or a benzoxazole nucleus; and $R_4$, $R_5$, $R_6$, $X_2$ and n each has the same meaning as described above in the general formula (II).

Specific examples of sensitizing dyes which can be employed in the practice of the present invention are illustrated below. However, the present invention is not to be interpreted as being limited to the dyes specifically described below.

Specific examples of the dyes represented by the general formula (I) include the following dyes.

Dye (I-1)

-continued
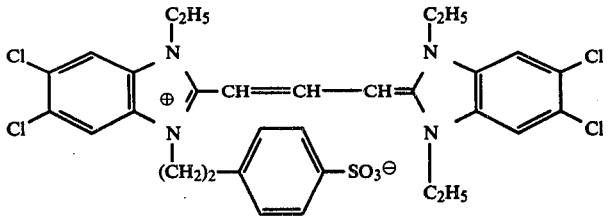
Dye (I-2)
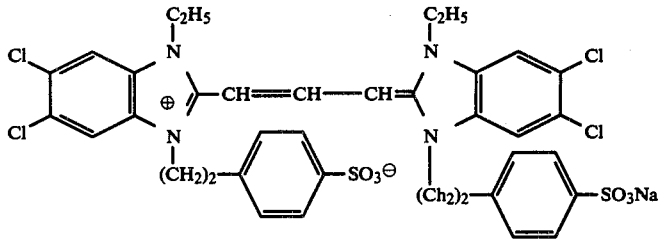
Dye (I-3)
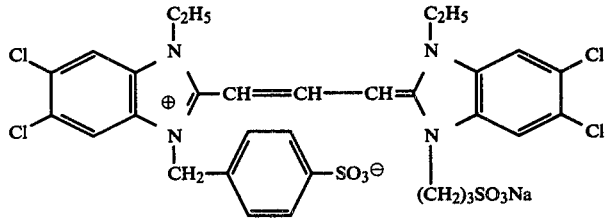
Dye (I-4)
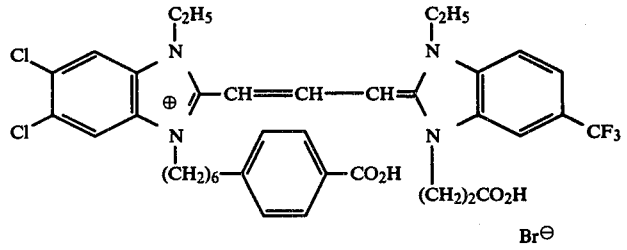
Dye (I-5)
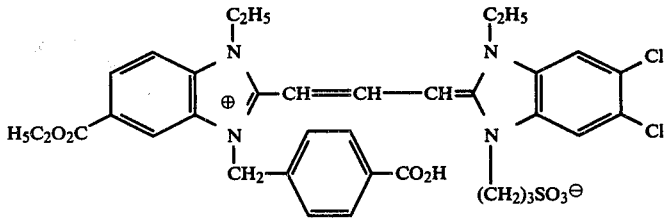
Dye (I-6)
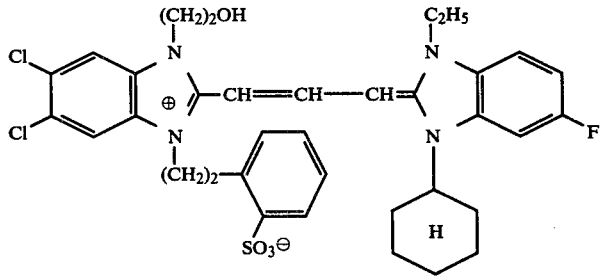
Dye (I-7)

-continued
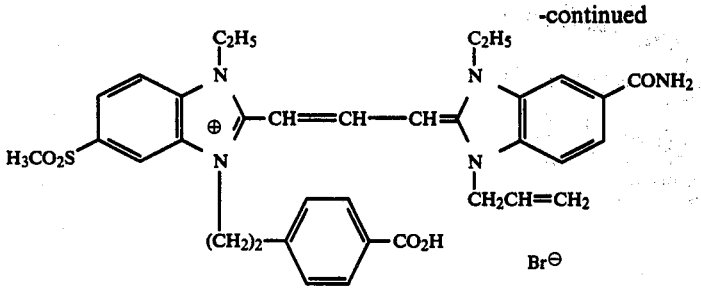
Dye (I-8)
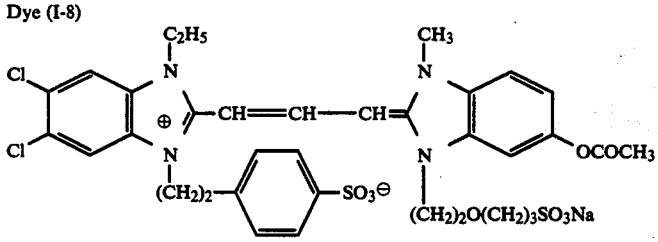
Dye (I-9)
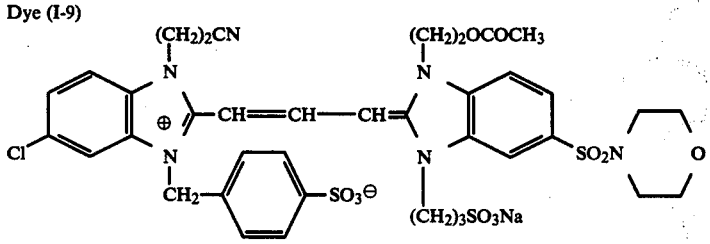
Dye (I-10)
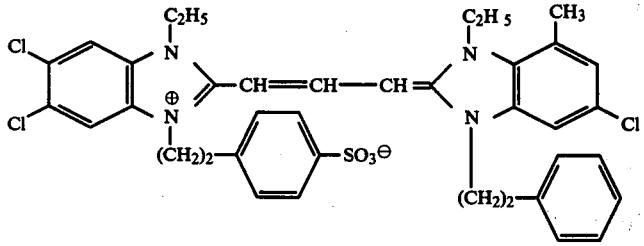
Dye (I-11)
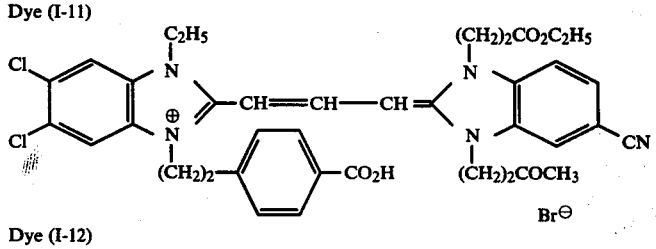
Dye (I-12)
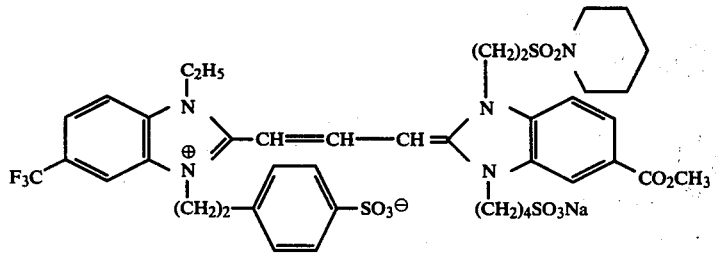
Dye (I-13)
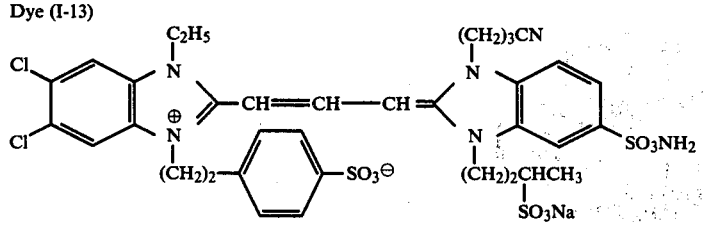
Dye (I-14)

-continued
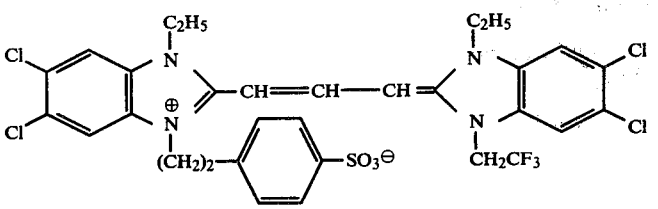
Specific examples of the dyes represented by the general formula (II) include the following dyes.
Dye (II-1)
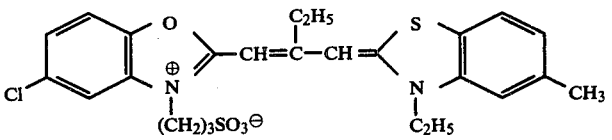
Dye (II-2)
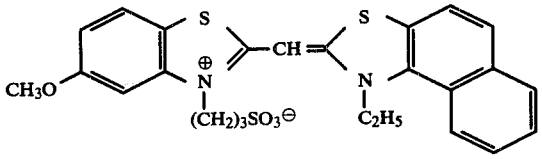
Dye (II-3)
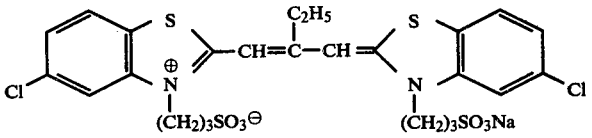
Dye (II-4)
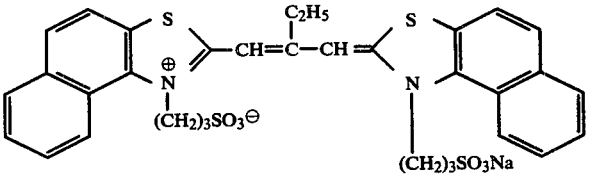
Dye (II-5)
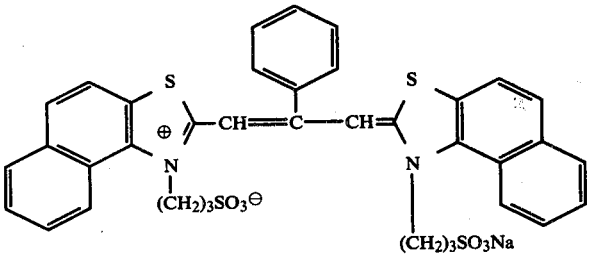
Dye (II-6)
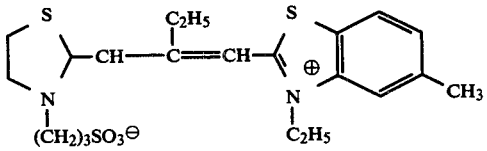
Dye (II-7)
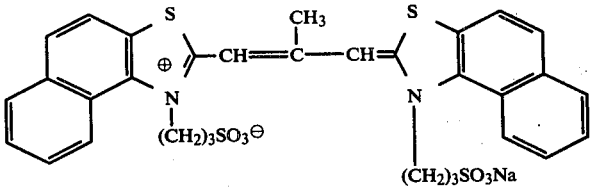
Dye (II-8)

-continued
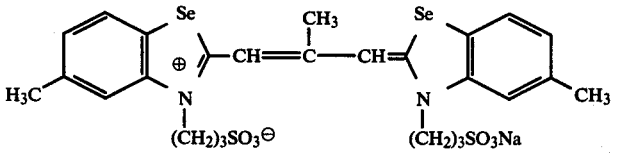
Dye(II-9)
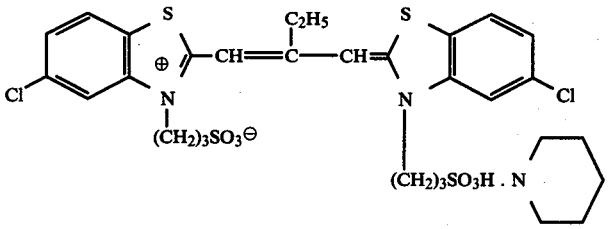
Dye (II-10)
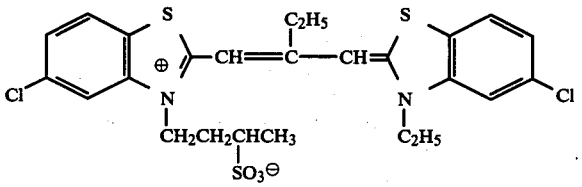
Dye (II-11)
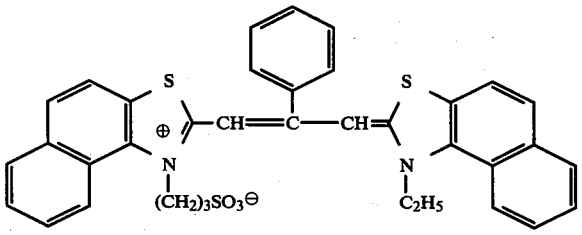
Dye (II-12)
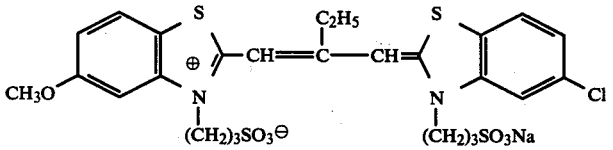
Dye (II-13)
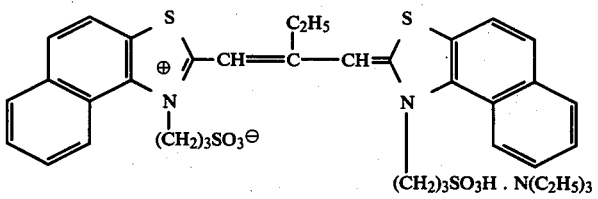
Dye (II-14)
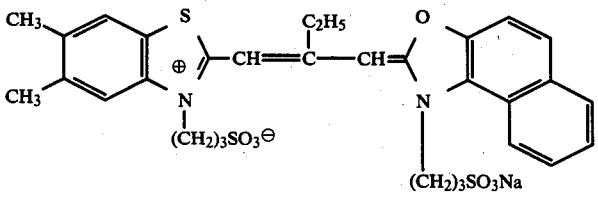
Dye (II-15)
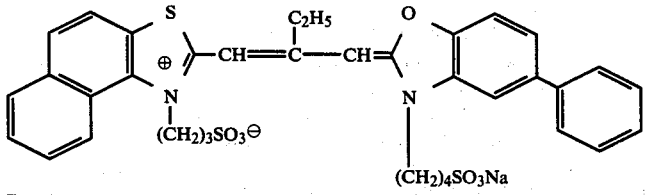
Dye (II-16)

-continued

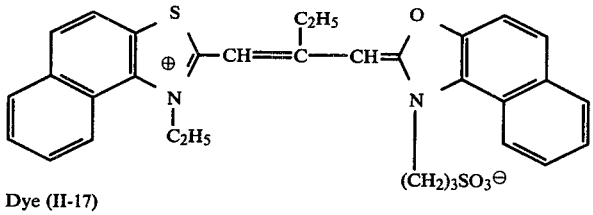

Dye (II-17)

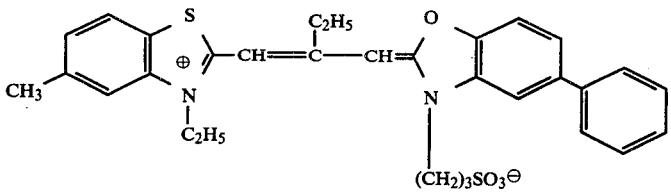

The sensitizing dyes which can be used to advantage in the present invention can easily be synthesized by one skilled in the art in accordance with the procedures described in the following examples or by reference to F. M. Hamer, *The Cyanine Dyes and Related Compounds,* Interscience Publishers, New York, (1964). In addition, sensitizing dyes of the kind which are not described therein can also be synthesized by procedures similar to the above-described ones.

The sensitizing dyes represented by the general formula (I), which can be used to advantage in the present invention, can be easily synthesized by one skilled in the art in accordance with the procedures described in the following Synthesis Examples 1 or 2 and with procedures similar to those set forth in Synthesis Examples 1 or 2. That is, using procedures similar to the Synthesis Example 1, a 2-methylbenzimidazolium salt having an aralkyl group substituted with an acidic group at the 3-position is condensed with a benzimidazolium salt having a β-anilinovinyl group at the 2-position in a suitable solvent (e.g., dimethyl sulfoxide, N,N-dimethylformamide, acetonitrile and the like) in the presence of a base (e.g., triethylamine and the like) so as to produce the sensitizing dyes represented by the general formula (I). Further, using procedures similar to those set forth in Synthesis Example 2, a 2-methylbenzimidazolium salt having an aralkyl group substituted with an acidic group at the 3-position is condensed with chloral in the presence of a sodium alcoholate (e.g., sodium ethylate, sodium methylate and the like) so as to produce the sensitizing dyes represented by the general formula (I). The above 2-methylbenzimidazolium salt having an aralkyl group substituted with an acidic group at the 3-position can be easily synthesized from a 2-methylbenzimidazole derivative and an aralkyl halide in a manner similar to a synthesis of an ordinary benzimidazolium salt. The sensitizing dyes represented by the general formula (II) are known compounds as described in U.S. Pat. No. 2,503,776.

Specific synthesis examples of the dyes represented by the general formula (I) are described below. Unless otherwise indicated herein, all parts, percents, ratios and the like are by weight.

SYNTHESIS EXAMPLE 1

Synthesis of Dye (I-1)

3.5 g of 2-(β-anilinovinyl)-5,6-dichloro-1,3-diethylbenzimidazolium iodide, 3.0 g of p-[β-(5,6-dichloro-1-ethyl-2-methyl-3-benzimidazolium)ethyl]benzene sulfonate, 80 ml of dimethylformamide, 4 ml of acetic anhydride and 4 ml of trimethylamine were mixed with stirring for 1 hour while being heated at 130° C. After cooling, 500 ml of diethyl ether was added thereto with ample stirring. The resulting supernatant solution was discarded and the residual oily matter was crystallized by adding methanol thereto with stirring and heating. The resulting crystals were collected by filtration. Then, 3.5 g of Dye (I-1) was obtained. The melting point was higher than 280° C.

SYNTHESIS EXAMPLE 2

Synthesis of Dye (I-2)

3.3 g of metallic sodium was dissolved in 330 ml of absolute ethanol, and then 10 g of p-[β-(5,6-dichloro-1-ethyl-2-methyl-3-benzimidazolium)ethyl]benzene sulfonate and 3.5 g of chloral were added thereto. The mixture was refluxed with stirring for 2 hours while being heated. After cooling, the deposited crystals were collected by filtration, and washed with water. 7.2 g of Dye (I-2) was obtained. The melting point was higher than 280° C.

The sensitizing dyes used in the practice of the present invention can be added to a silver halide emulsion as a solution prepared by dissolving the dyes in water or a water-miscible organic solvent such as methanol, ethanol, methyl Cellosolve, pyridine or the like. The sensitizing dyes can be dissolved using ultrasonic vibration, e.g., as disclosed in U.S. Pat. No. 3,485,634. In addition, suitable methods for dissolving or dispersing the sensitizing dyes used in the present invention into an emulsion include those methods as described in U.S. Pat. Nos. 3,482,981, 3,585,195, 3,469,987, 3,425,835 and 3,342,605, British Pat. Nos. 1,271,329, 1,038,029 and 1,121,174, and U.S. Pat. Nos. 3,660,101 and 3,658,546. Further, the method as disclosed in German Patent Application (OLS) No. 2,104,283 and the method as disclosed in U.S. Pat. No. 3,649,286 can be employed.

The silver halide photographic emulsions which can be used in the present invention can be produced in a conventional manner, and can contain silver chloride, silver bromide, silver iodide, silver chlorobromide, silver chloroiodide, silver iodobromide or silver chlorobromoiodide grains which can be produced using a single jet method, a double jet method or a combination of these methods, followed by ripening. A preferred silver halide is silver iodobromide or silver chloroiodobromide (preferably having an iodide content of not more than about 10 mol%). Both silver halide grains of a conventional grain size and fine silver halide grains can be employed. A preferred mean diameter of the grains (measured by, e.g., a projected area method or a number average method) ranges from about 0.04 micron to 2 microns.

Various commonly used chemical sensitization techniques, e.g., a gold sensitization techniques (as disclosed in, e.g., U.S. Pat. Nos. 2,540,085, 2,597,856, 2,597,915 and 2,399,083), sensitization techniques using the Group VIII metal ions, sulfur sensitization techniques (as disclosed in, e.g., U.S. Pat. Nos. 1,574,944, 2,278,947, 2,440,206, 2,410,689, 3,189,458 and 3,415,649), reduction sensitization techniques (as disclosed in, e.g., U.S. Pat. Nos. 2,518,698, 2,419,974 and 2,983,610), can be applied to the photographic emulsions of the present invention, individually or as a combination thereof.

Specific examples of chemical sensitizers which may be employed for the emulsions of the present invention include sulfur sensitizers such as allylthiocarbamide, thiourea, sodium thiosulfate, cystine and the like; sensitizers consisting of noble metal salts such as potassium chloroaurate, aurous thiosulfate, potassium chloropalladate and the like; reduction sensitizers such as stannous chloride, phenyl hydrazine, reductone, etc.; and so on. Also, other sensitizers such as polyoxyethylene compounds, polyoxypropylene compounds, compounds of the kind of which contain a quaternary ammonium group, etc., may be added to the photographic emulsions of the present invention.

The photographic emulsions of the present invention can contain a wide variety of compounds for purposes of preventing a reduction in sensitivity and foggind during production, storage or processing. A large number of compounds such as nitrobenzimidazole, ammonium chloroplatinate, 4-hydroxy-6-methyl-1,3,3a,7-tetrazaindene, 3-methylbenzothiazole, 1-phenyl-5-mercaptotetrazole and as well as other heterocyclic ring compounds; mercury-containing compounds; mercapto compounds; metal salts and so on are well known as such compounds. Examples of compounds usable for these purposes are described in C. E. K. Mees and T. H. James, *The Theory of the Photographic Process,* 3rd Ed., pages 344 and 349, Macmillan, New York (1966), and the original references cited therein. In addition, suitable compounds are disclosed in, e.g., U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188 and so on.

Surface active agents can be added to the photographic emulsions of the present invention either individually or as a mixture thereof. The surface active agents are generally employed as a coating aid, but sometimes they are used for other purposes, for example, emulsifying dispersion, sensitization, improvement in the photographic characteristics, prevention of the generation of static charges and adhesion, and so on.

Examples of suitable surface active agents include natural surface active agents such as saponin; nonionic surface active agents of the alkylene oxide type, glycerin type, glycidol type and so on; cationic surface active agents such as higher alkylamines, quaternary ammonium salts, heterocyclic compounds such as pyridine and other heterocyclics, phosphoniums, sulfoniums and so on; anionic surface active agents containing acid groups such as a carboxylic acid group, a sulfonic acid group, a phosphoric acid group, a sulfate group, a phosphate group, etc.; and ampholytic surface active agents of the amino acid type, the aminosulfonic acid type, the sulfates or phosphates of aminoalcohols and so on.

Specific examples of such surface active agents employable herein are disclosed in, for example, U.S. Pat. Nos. 2,271,623, 2,240,427, 2,288,226, 2,739,891, 3,068,101, 3,158,484, 3,201,253, 3,210,191, 3,294,540, 3,415,649, 3,441,413, 3,442,654, 3,475,174 and 3,545,974, German Patent Application (OLS) No. 1,942,665, and British Pat. Nos. 1,077,317 and 1,198,450, and as well as in Ryohei Oda, *Synthesis and Applications of Surface Active Agents,* Maki Shoten, (1964), A. M. Schwartz et al., *Surface Active Agents,* Interscience Publications Incorporated, (1958), J. P. Sisley et al., *Encyclopedia of Surface Active Agents,* Vol. 2, Chemical Publishing Company, (1964) and so on.

The silver halide photographic emulsions which can be employed in the present invention can contain compounds of the kind which can produce dyes by reacting with an oxidized developing agent, i.e., a so-called "coupler", and the dispersing agents therefor when used for color photosensitive materials. These couplers usually have a structure to prevent diffusion of the couplers into other layers during production or processing.

The couplers used in this invention are compounds which form color on coupling by color development with an aromatic primary amino color developing agent such as, for instance, a phenylenediamine derivative and an aminophenol derivative. Examples of such couplers are 5-pyrazolone couplers, cyanoacetylcoumarone couplers, open-chain acylacetonitrile couplers, acylacetyl couplers, acylacetanilide couplers (e.g., alkylacetanilide couplers, aroylacetanilide couplers and pivaloylacetanilide couplers), naphthol couplers and phenol couplers.

Of the color couplers which can be present in the silver halide photographic emulsion, magenta couplers are particularly preferred. 5-Pyrazolone couplers, cyanoacetylcoumarone couplers, indazolone couplers, etc., are used as the magenta coupler.

The magenta couplers useful in the practice of the present invention may be represented by the general formula (III):

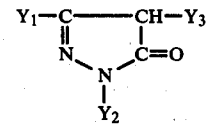

(III)

wherein $Y_1$ represents a primary, secondary, or tertiary alkyl group (e.g., a methyl group, a propyl group, an n-butyl group, a t-butyl group, a hexyl group, a 2-hydroxyethyl group, a 2-phenylethyl group, etc.), an aryl group, a heterocyclic group (e.g., a quinolinyl group, a pyridyl group, a benzofuranyl group, an oxazolyl group, etc.), an amino group (e.g., a methylamino group, a diethylamino group, a phenylamino group, a tolylamino group, a 4-(3-sulfobenzamino)anilino group, a 2-chloro-5-acylaminoanilino group, a 2-chloro-5-alkoxycarbonylanilino group, a 2-trifluoromethylphenylamino group, etc.), a carbonamido group (e.g., an alkylcarbonamido group such as an ethylcarbonamido group, an arylcarbonamido group, a heterocyclic carbonamido group such as a benzothiazolylcarbonamido group), a sulfonamido group (e.g., a sulfonamido group, an alkylsulfonamido group, an arylsulfonamido group, a heterocyclic sulfonamido group, etc.), or a ureido group (e.g., an alkylureido group, an arylureido group, a heterocyclic ureido group, etc.); $Y_2$ represents an aryl group (e.g., a naphthyl group, a phenyl group, a 2,4,6-trichlorophenyl group, a 2-chloro-4,6-dimethylphenyl group, a 2,6-dichloro-4-methoxyphenyl group, a 4-methylphenyl group, a 4-acylaminophenyl group, a 4-alkylaminophenyl group, a 4-trichloromethylphenyl group, a 3,5-dibromophenyl group, etc.) or a heterocyclic group (e.g., a benzofuranyl group, a naphthoxazolyl group, a quinolinyl group, etc.); and $Y_3$ represents a hydrogen atom or a group which can be released at coupling.

Cyan couplers are also particularly preferred as the color couplers which can be present in the silver halide photographic emulsion.

The cyan couplers useful in the practice of the present invention may be represented by the general formula (IV) or (V):

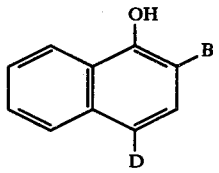

(IV)

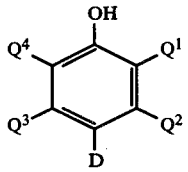

(V)

wherein B represents a substituent generally used for cyan couplers, such as, for instance, a carbamyl group (e.g., an alkylcarbamyl group, an arylcarbamyl group such as a phenylcarbamyl group, a heterocyclic carbamyl group such as a benzothiazolylcarbamyl group, etc.), a sulfamyl group (e.g., an alkylsulfamyl group, an arylsulfamyl group such as a phenylsulfamyl group, a heterocyclic sulfamyl group, etc.), an alkoxycarbonyl group, and an aryloxycarbonyl group; $Q^1$ represents an alkyl group, an aryl group, a heterocyclic group, an amino group (e.g., an amino group, an alkylamino group, an arylamino group, etc.), a carbonamido group (e.g., an alkylcarbonamido group, an arylcarbonamido group, a heterocyclic carbonamido group, etc.), a sulfonamido group, a sulfamyl group (e.g., an alkylsulfamyl group, an arylsulfamyl group, etc.), or a carbamyl group; $Q^2$, $Q^3$ and $Q^4$ each represents the groups as defined for $Q^1$, and further, a halogen atom, or an alkoxy group; and D represents a hydrogen atom or a group which can be released by coupling.

The couplers used in this invention can be four-equivalent couplers or two-equivalent couplers used for conventional color photographic materials and they can also be uncolored couplers or colored couplers. For instance, D in general formulae (IV) and (V) represents a hydrogen atom or a group which can be released at coupling but is particularly preferably a group rendering the coupler a two-equivalent coupler.

D represents a hydrogen atom, a halogen atom (e.g., a chlorine atom, a bromine atom, etc.), an indazolyl group, a cyclic imido group, an acyloxy group, an aryloxy group, an alkoxy group, a sulfo group, an arylazo group, and a heterocyclic azo group. Examples of these groups are described in the specifications of U.S. Pat. Nos. 2,423,730, 3,227,550 and 3,311,476 and British Pat. Nos. 1,084,480 and 1,165,563. Also, D can be a residue which can release a development inhibitor at development, such as an arylmonothio group (e.g., a phenylthio group, a 2-carboxyphenylthio group, etc.), a heterocyclic thio group, a 1-benzotriazolyl group, and a 1-benzodiazolyl group; and also the residues as described in German Patent Application (OLS) No. 2,414,006.

Specific examples of couplers which can be used in this invention are illustrated below but it is to be understood that the couplers in this invention are not to be construed as being limited to these couplers.

Magenta Couplers (M-1) 1-(2,4,6-Trichlorophenyl)-[3-(2,4-di-tert-amylphenoxyacetamido)benzamido]-5-pyrazolone (M-2) 1-(2,4,6-Trichlorophenyl)-3-[3-(2,4-di-tert-amylphenoxyacetamido)benzamido]-4-acetoxy-5-pyrazolone (M-3) 1-(2,4,6-Trichlorophenyl)-3-n-tetradecaneamido-4-(4-hydroxyphenylazo)-5-pyrazolone (M-4) 1-(2,4,6-Trichlorophenyl)-3-(5-n-tetradecaneamido-2-chloroanilino)-5-pyrazolone (M-5) 1-(2,4,6-Trichlorophenyl)-3-(5-tetradecyloxycarbonyl-2-chloroanilino)-4-(1-naphthylazo)-5-pyrazolone (M-6) 1-(2,4-Dichloro-6-methoxyphenyl)-3-(5-n-tetradecaneamido-2-chloroanilino)-4-benzyloxycarbonyloxy-5-pyrazolone Cyan Couplers (C-1) 1-Hydroxy-N-[γ-(2,4-di-tert-amylphenoxypropyl)]-2-naphthamide (C-2) 1-Hydroxy-4-[2-(2-hexyldecyloxycarbonyl)phenylazo]-2-[N-(1-naphthyl)]naphthamide (C-3) 1-Hydroxy-4-chloro-N-[α-(2,4-di-tert-amylphenoxy)butyl]-2-naphthamide (C-4) 5-Methyl-4,6-dichloro-2-[α-(3-n-pentadecylphenoxy)butyramido]phenol (C-5) 1-Hydroxy-4-iodo-N-dodecyl-2-naphthamide (C-6) 5-Methoxy-2-[α-(3-n-pentadecylphenoxy)butyramido]-4-(1-phenyl-5-tetrazolylthio)phenol Conventionally used open-chain diketomethylene compounds, for example, those compounds as disclosed in U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Application (OLS) Nos. 2,057,941, 2,213,461, 2,219,917, 2,261,361 and 2,263,875, and so on can be employed as yellow couplers.

Development inhibiting compound-releasing type couplers (the so-called DIR couplers), and compounds which can release compounds having a development inhibiting action can be also incorporated into the photographic emulsions of the present invention.

Specific examples of the above-described materials are disclosed in U.S. Pat. Nos. 3,148,062, 3,227,554, 3,253,924, 3,617,291, 3,622,328 and 3,705,201, and British Patent No. 1,201,110, U.S. Pat. Nos. 3,297,445, 3,379,529 and 3,639,417 and so on.

Two or more of the above-described couplers and the like can be incorporated into the same layer or the same compound can also be incorporated into two or more different layers to achieve the characteristics required for the photo-sensitive materials.

Acylated gelatins such as phthaloylated gelatin and malonoylated gelatin, cellulose compounds such as hydroxyethylcellulose and carboxymethylcellulose, soluble starches such as dextrin, and hydrophilic polymers such as polyvinyl alcohol, polyvinyl pyrrolidone, polyacrylamide and polystyrene sulfonic acid can be added to the silver halide photographic emulsions employed in the present invention in addition to gelatin as a protective colloid, and further, plasticizers for dimensional stabilization, latex polymers and matting agents can be added thereto.

The finished emulsion is coated on a suitable support such as baryta paper, resin-coated paper, synthetic paper, triacetate film, polyethylene terephthalate film, glass plates or other plastic film bases.

Silver images can be produced by the photographic sensitive materials prepared using the photographic emulsions of the present invention and subjecting them to a black-and-white development processing in a conventional manner and, on the other hand, the production of dye images requires a color development processing after exposure to light. Color development processing involves basically the processes of color development, bleaching and fixing. In such an instance, each of these processes can be carried out independently or two or more processes can be performed at the same time by using one processing solution which can achieve the respective functions simultaneously. As an example of such cases, mention may be made of a combined bleaching and fixing bath. In addition, each step of these processes can be divided into two or more sub-steps, or a combined color development, a first fixing and a bleaching-fixing processing can be employed. Moreover, various kinds of processes, other than the above-described ones, such as a prehardening, a neutralizing, the first development (monochromatic development), an image-stabilizing, washing, etc., may be optionally combined with the above-described processes for development processing. The temperature for processing should be in a suitable range for each case, which depends upon the kind of sensitive material and the processing formulation used therein. Temperatures higher than about 18° C. are chosen for processing in many cases. Temperatures in the range of about 20° C. to about 60° C. are very frequently employed and, in particular, temperatures in the range of 30° C. to 60° C. have recently been employed. In addition, it is not necessary to use the same temperature in each of a series of processes.

Each of sensitizing dyes of the present invention is used in an amount usually employed for supersensitization, e.g., $5\times10^{-2}$ mol to $1\times10^{-6}$ mol per mol of silver. A preferred molar ratio of the amount of the dye represented by the general formula (I) to that of the dye represented by the general formula (II) ranges from about 10:1 to 1:50. An appropriate amount of the coupler in the silver halide emulsion of this invention is about 0.005 to about 2 mol/mol of silver, preferably 0.007 to 0.5 mol/mol of silver.

The supersensitizing combinations disclosed in the present invention can be used for sensitization of a wide variety of both color and black-and-white silver halide photographic emulsions. Specific examples of such emulsions include color positive emulsions, emulsions for color papers, color negative emulsions, reversal color emulsions (with or without couplers), emulsions for photographic light-sensitive materials for the graphic arts (e.g., lithographic films and the like), emulsions employed for photosensitive materials for recording cathode ray tube displays, emulsions for light-sensitive materials for recording X-rays (particularly direct and indirect materials using a fluorescent screen), emulsions for the colloid transfer process (as disclosed in, e.g., U.S. Pat. No. 2,716,059), emulsions employed for the silver salt diffusion transfer process (as disclosed in, e.g., U.S. Pat. Nos. 2,352,014, 2,543,181, 3,020,155 and 2,861,885), emulsions for the color diffusion transfer process (as disclosed in, e.g., U.S. Pat. Nos. 3,087,817, 3,185,567, 2,983,606, 3,253,915, 3,227,550, 3,227,551, 3,227,552, 3,415,644, 3,415,645 and 3,415,646), emulsions for the dye transfer process (imbibition transfer process) (as disclosed in, e.g., U.S. Pat. No. 2,882,156), emulsions for the silver dye bleaching method as described in Friedman, *History of Color Photography,* particularly Chapter 24, American Photographic Publishers Co., (1944), and *British Journal of Photography,* Vol. 111, pp. 308–309, (Apr. 7, 1964) and so on, emulsions employed for recording print-out images (as disclosed in, e.g., U.S. Pat. No. 2,369,449, Belgian Patent No. 704,255 and so on), emulsions for the light-developing type print-out light-sensitive materials (direct print image) (as disclosed in, e.g., U.S. Pat. Nos. 3,033,682 and 3,287,137), emulsions employed for heat developable light-sensitive materials (as disclosed in, e.g., U.S. Pat. Nos. 3,152,904, 3,312,550 and 3,148,122, British Patent No. 1,110,046 and so on), and emulsions employed for physical developing light-sensitive materials (as disclosed in, e.g., British Patents Nos. 920,277, 1,131,238 and so on).

The supersensitizing technique in accordance with the present invention is very useful for the production of, in particular, lithographic type photosensitive materials for the graphic arts, emulsions for multilayer coupler-in-the-emulsion type color photosensitive materials which include particularly emulsions for reversal color and negative color photosensitive materials, high sensitive negative color photosensitive materials and micronegative photosensitive materials.

The following examples are given to illustrate the present invention more specifically.

EXAMPLE 1

Silver halide grains were precipitated using a single jet method, subjected to physical ripening, desalted and followed by chemical ripening. Thus, a silver iodobromide emulsion (iodide content: 8 mol%) was obtained. The silver halide grains present in this emulsion had a mean diameter of 0.7 micron. This emulsion contained 0.52 mol of silver halide per kg thereof.

The required number of 1 kg portions of this emulsion were weighed out, which were then placed in a 50° C. thermostatic bath to melt the emulsion. Methanol solutions of the sensitizing dyes of the present invention as shown in the table below were added to the emulsion portions in predetermined amounts as shown in the table below, and mixed and stirred in a 40° C. thermostatic bath. To each of emulsion portions were added 10 ml of a 1% by weight aqueous solution of 4-hydroxy-6-methyl-1,3,3a,7-tetrazaindene and 20 ml of a 1% by weight aqueous solution of 2-hydroxy-4,6-dichlorotriazine sodium salt, and stirred. Each of the thus-finished emulsion portions was applied to a cellulose triacetate film support in a dry thickness of 5 microns and then dried. Thus, samples of light-sensitive materials were obtained. Each of these film samples was cut into strips. Two of the strips were wedgewise exposed using a sensitometer containing a light source of a color temperature of 5400° K., covered by a yellow filter (SC-50) made by Fuji Photo Film Co., Ltd., and a blue filter (Wratten-47 B) made by Eastman Kodak Company, respectively. The intensity of illumination was 256 lux and the exposure time was 1/20 sec. One remaining strip was exposed using a grating spectro photograph having a tungsten light source of a color temperature of 2666° K. to obtain a spectrogram. The thus-exposed strips were development-processed at 20° C. for 7 minutes using a developer having the following composition, followed by stopping, fixing and washing.

| Composition of the Developer | |
|---|---|
| Water | 700 ml |
| Monomethyl-p-aminophenol (½ sulfate) | 2 g |
| Sodium Sulfite (anhydrous) | 100 g |
| Hydroquinone | 5 g |
| Borax (pentahydrate) | 1.5 g |
| Water to make | 1 l |

Thus, strips having the prescribed black-and-white images were obtained. The density of these images was measured using a P-type densitometer (made by Fuji Photo Film Co., Ltd.). Thus, the minus blue sensitivity ($S_Y$) and the blue sensitivity ($S_B$) were obtained. The standard point of the optical density to determine the sensitivity was fog+0.20.

The results obtained are shown in Table 1. The sensitivity is shown as a relative value.

TABLE 1

| Run No. | Dye and Amount Used × $10^{-5}$ mol | | Dye and Amount Used × $10^{-5}$ mol | | $S_Y$ | $S_B$ | Fog |
|---|---|---|---|---|---|---|---|
| 1-1 | | — | | — | — | 100 | 0.05 |
| 1-2 | (I-1) | 2.5 | | — | 100 | 76 | 0.05 |
| 1-3 | (I-3) | 2.5 | | — | 103 | 86 | 0.05 |
| 1-4 | " | 5 | | — | 148 | 77 | 0.05 |
| 1-5 | | — | (II-4) | 5 | 371 | 70 | 0.05 |
| 1-6 | (I-3) | 2.5 | (II-4) | 5 | 575 | 80 | 0.05 |
| 1-7 | " | 5 | " | 5 | 588 | 74 | 0.05 |
| 1-8 | | — | (II-7) | 5 | 214 | 92 | 0.05 |
| 1-9 | (I-3) | 2.5 | (II-7) | 5 | 317 | 88 | 0.05 |
| 1-10 | " | 5 | " | 5 | 340 | 85 | 0.05 |

The sensitivity $S_Y$ is a relative value which is obtained by the sensitivity attained with Run No. 1-2 being assumed to be 100.

It can be clearly understood from the results of Table 1 that excellent effects with the combination of the sensitizing dyes employed in the present invention are achieved. Namely, the combined use of Dye (II-4) with Dye (I-3) increases the spectral sensitivity of Dye (II-4) by a factor of more than about 1.5 (Run Nos. from 1-5 to 1-7), the combined use of Dye (II-7) with Dye (I-3) increases the spectral sensitivity of Dye (II-7) by a factor of about 1.5 (Run Nos. from 1-8 to 1-10).

EXAMPLE 2

Samples of light-sensitive materials (transparent films) were prepared using the sensitizing dyes of the present invention and another class of sensitizing dyes employed for comparison being added and mixed in various combinations to similar emulsion portions to those which were prepared in Example 1 using the same procedures as in Example 1. One strip of these film samples each was allowed to stand for 3 days under a temperature of 50° C. and a relative humidity of 80%, and another strip thereof was allowed to stand for 3 days under a temperature of 50° C. and a relative humidity of 20% with the intention of testing the storage stability thereof. On the other hand, the standard sample was allowed to stand at a temperature between 20° and 25° C. and a relative humidity of 50 to 60%.

The samples thus kept under the conditions described above were wedgewise exposed in the same manner as in Example 1, and development-processed at 20° C. for 7 minutes using the same developer, stopping solution and fixing solution as used in Example 1. The standard point of the optical density to determine the sensitivity was fog +0.20.

TABLE 2

| Run No. | Dye and Amount Used × $10^{-5}$ mol | | | | | | 20°-25° C., 50-60% RH $S_Y$ | 20°-25° C., 50-60% RH Fog | 50° C., 20% $S_Y$ | 50° C., 20% Fog | 50° C., 80% $S_Y$ | 50° C., 80% Fog |
|---|---|---|---|---|---|---|---|---|---|---|---|---|
| 2-1 | | — | | — | | — | — | 0.05 | — | 0.08 | — | 0.06 |
| 2-2 | (I-2) | 3 | (II-7) | 6 | (II-8) | 6 | 110 | 0.05 | 96 | 0.09 | 110 | 0.06 |
| 2-3 | " | 6 | " | 6 | " | 6 | 118 | 0.05 | 112 | 0.09 | 121 | 0.06 |
| 2-4 | (A) for comparison | 3 | (II-7) | 6 | (II-8) | 6 | 129 | 0.05 | 37 | 0.28 | 24 | 0.10 |
| 2-5 | (A) for comparison | 6 | " | 6 | " | 6 | 136 | 0.05 | 55 | 0.32 | 30 | 0.10 |

The structural formula of the dye employed for comparison in this example is illustrated below:

Comparison Dye (A)

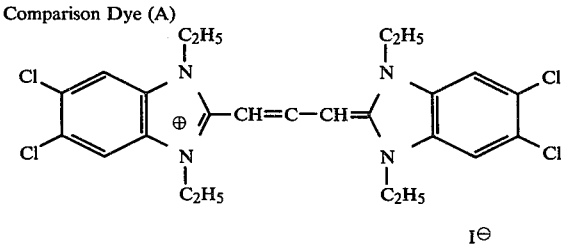

Table 2 shows the results obtained from testing the storage properties of each of samples which were prepared using the sensitizing dyes of the present invention and sensitizing dyes employed for comparison. It can be understood from the results in the table that the sensitizing dyes of the present invention exert excellent effects upon the storage property of sensitive materials. Namely, the combined use of Dye (I-2), Dye (II-7) and Dye (II-8), for example, results in a slight increase of fog and a very small variation in sensitivity even when the sensitive material containing such a combination is allowed to stand for a long time under the conditions of either high temperature and low humidity (hereinafter described as Condition-2), or high temperature and high humidity (hereinafter described as Condition-3). Stated in detail, the extent of the variation in the sensitivity of each of the samples of the present invention with the lapse of time under Condition-2 and Condition-3, respectively, is not increased beyond 15% with respect to the reference sample which is allowed to stand under the condition of an ordinary temperature and humidity (hereinafter described as Condition-1) (See Run Nos. 2-2 and 2-3). On the other hand, the samples prepared using Dye (A) which is employed for comparison exhibit a large reduction in sensitivity and a remarkable increase in fog under Condition-2 and Condition-3, compared with Condition-1 (See Run Nos. 2-4 and 2-5).

EXAMPLE 3

80 g of 1-hydroxy-N-[γ-(2,4-di-tert-amylphenoxypropyl)]-2-naphthamide was completely dissolved in a mixed solution of 100 ml of tricresyl phosphate and 100 ml of ethyl acetate. Further, 2 g of sorbitan monolaurate was dissolved therein. The resulting solution was added to 1 kg of a 10 wt% aqueous gelatin solution to which 2.5 g of sodium dodecylbenzenesulfonate had been added as an aqueous solution, followed by high-speed stirring and supersonic agitation to obtain an emulsified product.

Silver halide grains were precipitated using a single jet method, subjected to physical ripening, desalted and followed by chemical ripening. Thus, a silver iodobromide emulsion (iodide content: 8 mol%) was obtained. The silver halide grains present in this emulsion had a mean diameter of 0.7 micron. This emulsion contained 0.52 mol of silver halide per kg thereof.

This silver iodobromide emulsion (1 kg) was weighed out and placed in a pot, and melted in a constant temperature bath at 50° C. Methanol solutions of sensitizing dyes of the present invention and sensitizing dyes for comparison were respectively added in predetermined amounts to the emulsion, which was then mixed with stirring at 40° C. and allowed to stand for 15 minutes. 300 g of the above emulsified product which was melted was added thereto, and further, 10 ml of a 1 wt% aqueous solution of 4-hydroxy-6-methyl-1,3,3a,7-tetrazaindene, 10 ml of a 1 wt% aqueous solution of 1-hydroxy-3,5-dichlorotriazine sodium salt and 10 ml of a 1 wt% aqueous solution of sodium dodecylbenzenesulfonate were successively added followed by stirring. Each of the thus-finished emulsion portions was applied to a cellulose triacetate film support in a dry thickness of 5 microns and then dried. Thus, samples of light-sensitive materials were obtained.

Each of these film samples was cut into strips. One strip of each of these film samples was allowed to stand for 3 days under a temperature of 50° C. and a relative humidity of 80%, and another strip thereof was allowed to stand for 3 days under a temperature of 50° C. and a relative humidity of 20% with the intention of testing the storage stability thereof. On the other hand, the standard sample was allowed to stand at a temperature between 20° and 25° C. and a relative humidity of 50 to 60%. The samples thus-stored under the conditions described above were wedgewise exposed using a sensitometer containing a light source of a color temperature of 5400° K., covered by a red filter (SC-60) made by Fuji Photo Film Co., Ltd. The intensity of illumination was 256 lux and the exposure time was 1/20 sec.

The above strips were developed at 38° C. using the following color negative development procedure.

| | |
|---|---|
| 1. Color Development | 3 min and 15 sec |
| 2. Bleaching | 6 min and 30 sec |
| 3. Washing | 3 min and 15 sec |
| 4. Fixing | 6 min and 30 sec |
| 5. Washing | 3 min and 15 sec |
| 6. Stabilizing | 3 min and 15 sec |

The processing solutions used for the above steps had the following compositions.

| | |
|---|---|
| Color Developer | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 l |
| Bleaching Solution | |
| Ammonium Bromide | 160.0 g |
| Aqueous Ammonia (28 wt %) | 25.0 ml |
| Sodium Ethylenediaminetetraacetate Iron Salt | 130.0 g |
| Glacial Acetic Acid | 14.0 ml |
| Water to make | 1 l |
| Fixing Solution | |
| Sodium Tetrapolyphosphate | 2.0 g |
| Sodium Sulfite | 4.0 g |
| Ammonium Thiosulfate (70 wt % aq. soln.) | 175.0 ml |
| Sodium Bisulfite | 4.6 g |
| Water to make | 1 l |
| Stabilizing Solution | |
| Formaldehyde (38 wt % aq. soln.) | 8.0 ml |
| Water to make | 1 l |

The resulting strips were subjected to measurement using a P-type densitometer made by Fuji Photo Film Co., Ltd. to obtain the red sensitivity ($S_R$). The standard point of the optical density to determine the sensitivity was (fog +0.20). The results obtained are shown as relative values in Tables 3 to 7 below.

TABLE 3

| Run No. | Sensitizing Dye and Amount Used × $10^{-5}$ mol | | | | 20°-25° C. 50-60% RH $S_R$ | 20°-25° C. 50-60% RH Fog | 50° C. 20% RH $S_R$ | 50° C. 20% RH Fog | 50° C. 80% RH $S_R$ | 50° C. 80% RH Fog |
|---|---|---|---|---|---|---|---|---|---|---|
| 1 | | — | | — | — | 0.10 | — | 0.14 | — | 0.15 |
| 2 | (I-1) | 3 | (II-9) | 10 | 100 | 0.10 | 105 | 0.13 | 100 | 0.15 |
| 3 | (I-1) | 6 | (II-9) | 10 | 105 | 0.10 | 108 | 0.13 | 102 | 0.15 |
| 4 | (I-1) | 12 | (II-9) | 10 | 90 | 0.12 | 92 | 0.15 | 87 | 0.17 |
| 5 | (B) (for comparison) | 3 | (II-9) | 10 | 105 | 0.10 | 112 | 0.18 | 98 | 0.17 |
| 6 | (B) | 6 | (II-9) | 10 | 97 | 0.12 | 107 | 0.20 | 90 | 0.18 |

TABLE 3-continued

| Run No. | Sensitizing Dye and Amount Used × $10^{-5}$ mol | | | | 20°-25° C. 50-60% RH $S_R$ | Fog | 50° C. 20% RH $S_R$ | Fog | 50° C. 80% RH $S_R$ | Fog |
|---|---|---|---|---|---|---|---|---|---|---|
| | (for comparison) | | | | | | | | | |
| 7 | (B) (for comparison) | 12 | (II-9) | 10 | 90 | 0.15 | 101 | 0.24 | 81 | 0.20 |

TABLE 4

| Run No. | Sensitizing Dye and Amount Used × $10^{-5}$ mol | | | | 20°-25° C. 50-60% RH $S_R$ | Fog | 50° C. 20% RH $S_R$ | Fog | 50° C. 80% RH $S_R$ | Fog |
|---|---|---|---|---|---|---|---|---|---|---|
| 8 | | — | | — | — | 0.10 | — | 0.14 | — | 0.15 |
| 9 | (I-8) | 3 | (II-13) | 2 | 100 | 0.10 | 104 | 0.13 | 97 | 0.15 |
| 10 | (I-8) | 6 | (II-13) | 2 | 118 | 0.10 | 123 | 0.13 | 114 | 0.15 |
| 11 | (I-8) | 12 | (II-13) | 2 | 116 | 0.11 | 103 | 0.15 | 104 | 0.16 |
| 12 | (B) (for comparison) | 3 | (II-13) | 2 | 103 | 0.10 | 111 | 0.16 | 95 | 0.17 |
| 13 | (B) (for comparison) | 6 | (II-13) | 2 | 118 | 0.11 | 129 | 0.19 | 109 | 0.18 |
| 14 | (B) (for comparison) | 12 | (II-13) | 2 | 103 | 0.13 | 107 | 0.24 | 93 | 0.19 |

TABLE 5

| Run No. | Sensitizing Dye and Amount Used × $10^{-5}$ mol | | | | | | 20°-25° C. 50-60% RH $^R$ | Fog | 50° C. 20% RH $S_R$ | Fog | 50° C. 80% RH $S_R$ | Fog |
|---|---|---|---|---|---|---|---|---|---|---|---|---|
| 15 | | — | | — | | — | — | 0.10 | — | 0.14 | — | 0.15 |
| 16 | (I-2) | 3 | (II-9) | 8 | (II-13) | 1 | 100 | 0.10 | 105 | 0.13 | 96 | 0.15 |
| 17 | (I-2) | 6 | (II-9) | 8 | (II-13) | 1 | 110 | 0.10 | 115 | 0.13 | 105 | 0.15 |
| 18 | (I-2) | 12 | (II-9) | 8 | (II-13) | 1 | 104 | 0.11 | 108 | 0.14 | 99 | 0.16 |
| 19 | (B) (for comparison) | 3 | (II-9) | 8 | (II-13) | 1 | 103 | 0.10 | 108 | 0.18 | 92 | 0.17 |
| 20 | (B) (for comparison) | 6 | (II-9) | 8 | (II-13) | 1 | 108 | 0.11 | 119 | 0.19 | 100 | 0.18 |
| 21 | (B) (for comparison) | 12 | (II-9) | 8 | (II-13) | 1 | 105 | 0.13 | 113 | 0.23 | 94 | 0.20 |

TABLE 6

| Run No. | Sensitizing Dye and Amount Used × $10^{-5}$ mol | | | | 20°-25° C. 50-60% RH $S_R$ | Fog | 50° C. 20% RH $S_R$ | Fog | 50°50° C. 80% RH $S_R$ | Fog |
|---|---|---|---|---|---|---|---|---|---|---|
| 22 | | — | | — | — | 0.10 | — | 0.14 | — | 0.15 |
| 23 | (I-2) | 3 | (II-8) | 10 | 100 | 0.10 | 105 | 0.13 | 96 | 0.15 |
| 24 | (I-2) | 6 | (II-8) | 10 | 100 | 0.10 | 104 | 0.14 | 100 | 0.15 |
| 25 | (I-2) | 12 | (II-8) | 10 | 94 | 0.11 | 98 | 0.15 | 91 | 0.17 |
| 26 | (B) (for comparison) | 3 | (II-8) | 10 | 100 | 0.10 | 105 | 0.18 | 92 | 0.19 |
| 27 | (B) (for comparison) | 6 | (II-8) | 10 | 103 | 0.11 | 107 | 0.19 | 93 | 0.19 |
| 28 | (B) (for compar- | 12 | (II-8) | 10 | 96 | 0.14 | 100 | 0.24 | 86 | 0.25 |

TABLE 6-continued

| Run No. | Sensitizing Dye and Amount Used × $10^{-5}$ mol | 20°-25° C. 50-60% RH $S_R$ | 20°-25° C. 50-60% RH Fog | 50° C. 20% RH $S_R$ | 50° C. 20% RH Fog | 50°50° C. 80% RH $S_R$ | 50°50° C. 80% RH Fog |
|---|---|---|---|---|---|---|---|
| | ison) | | | | | | |

TABLE 7

| Run No. | Sensitizing Dye and Amount Used × $10^{-5}$ mol | | | | | | 20°-25° C. 50-60% RH $S_R$ | 20°-25° C. 50-60% RH Fog | 50° C. 20% RH $S_R$ | 50° C. 20% RH Fog | 50° C. 80% RH $S_R$ | 50° C. 80% RH Fog |
|---|---|---|---|---|---|---|---|---|---|---|---|---|
| 29 | | — | | — | | — | — | 0.10 | — | 0.14 | — | 0.15 |
| 30 | (I-3) | 3 | (II-3) | 4 | (II-14) | 6 | 100 | 0.10 | 104 | 0.14 | 98 | 0.15 |
| 31 | (I-3) | 6 | (II-3) | 4 | (II-14) | 6 | 97 | 0.10 | 102 | 0.14 | 95 | 0.15 |
| 32 | (I-3) | 12 | (II-3) | 4 | (II-14) | 6 | 90 | 0.12 | 92 | 0.15 | 86 | 0.16 |
| 33 | (B) (for comparison) | 3 | (II-3) | 4 | (II-14) | 6 | 104 | 0.11 | 109 | 0.17 | 96 | 0.19 |
| 34 | (B) (for comparison) | 6 | (II-3) | 4 | (II-14) | 6 | 100 | 0.12 | 104 | 0.18 | 90 | 0.20 |
| 35 | (B) (for comparison) | 12 | (II-3) | 4 | (II-14) | 6 | 93 | 0.14 | 98 | 0.22 | 83 | 0.23 |

The structural formula of Dye (B) for comparison in this example is illustrated below:

Comparison Dye (B)

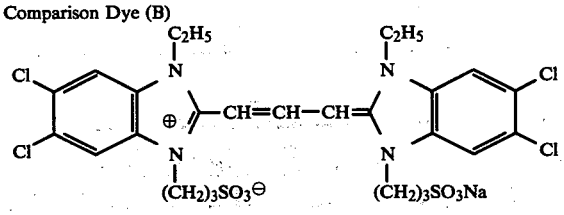

EXAMPLE 4

80 g of 1-(2,4,6-trichlorophenyl)-3-[3-(2,4-di-tertamylphenoxyacetamido)benzamido[-5-pyrazolone was completely dissolved in a mixed solution of 100 ml of tricresyl phosphate and 100 ml of ethyl acetate. Further, 2 g of sorbitan monolaurate was dissolved therein. The resulting solution was added to 1 kg of a 10 wt% aqueous gelatin solution to which 2.5 g of sodium dodecylbenzenesulfonate had been added as an aqueous solution, followed by high-speed stirring and supersonic agitation to obtain an emulsified product.

Silver halide grains were precipitated using a single jet method, subjected to physicl ripening, desalted and followed by chemical ripening. Thus, a silver iodobromide emulsion (iodide content: 8 mol%) was obtained. The silver halide grains present in this emulsion had a mean diameter of 0.7 micron. This emulsion contained 0.52 mol of silver halide per kg thereof.

This silver iodobromide emulsion (1 kg) was weighed out and placed in a pot, and melted in a constant temperature bath at 50° C. Methanol solutions of sensitizing dyes of the present invention and sensitizing dyes for comparison were respectively added in predetermined amounts to the emulsion, which was then mixed with stirring at 40° C. and allowed to stand for 15 minues. 300 g of the above emulsified product which was melted was added thereto, and further, 10 ml of a 1 wt% aqueous solution of 4-hydroxy-6-methyl-1,3,3a,7-tetrazaindene, 10 ml of a 1 wt% aqueous solution of 1-hydroxy-3,5-dichlorotriazine sodium salt and 10 ml of a 1 wt% aqueous solution of sodium dodecylbenzenesulfonate were successively added followed by stirring. Each of the thus-finished emulsion portions was applied to a cellulose triacetate film support in a dry thickness of 5 microns and then dried. Thus, samples of light-sensitive materials were obtained.

Each of these film samples was cut into strips. One strip of each of these film samples was allowed to stand for 3 days under a temperature of 50° C. and a relative humidity of 80%, and another strip thereof was allowed to stand for 3 days under a temperature of 50° C. and a relative humidity of 20% with the intention of testing the storage stability thereof. On the other hand, the standard sample was allowed to stand at a temperature between 20° and 25° C. and a relative humidity of 50 to 60%. The samples thus-stored under the conditions described above were wedgewise exposed using a sensitometer containing a light source of a color temperature of 5400° K., covered by a yellow filter (SC-50) made by Fuji Photo Film Co., Ltd. The intensity of illumination was 256 lux and the exposure time was 1/20 sec.

The above strips were developed at 38° C. using the following color negative development procedure.

| | |
|---|---|
| 1. Color Development | 3 min and 15 sec |
| 2. Bleaching | 6 min and 30 sec |
| 3. Washing | 3 min and 15 sec |
| 4. Fixing | 6 min and 30 sec |
| 5. Washing | 3 min and 15 sec |
| 6. Stabilizing | 3 min and 15 sec |

The processing solutions used for the above steps had the following compositions.

| Color Developer | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2- | 4.5 g |

-continued

| | |
|---|---|
| methylaniline Sulfate | |
| Water to make | 1 l |
| Bleaching Solution | |
| Ammonium Bromide | 160.0 g |
| Aqueous Ammonia (28 wt %) | 25.0 ml |
| Sodium Ethylenediaminetetraacetate Iron Salt | 130.0 g |
| Glacial Acetic Acid | 14.0 ml |
| Water to make | 1 l |
| Fixing Solution | |
| Sodium Tetrapolyphosphate | 2.0 g |
| Sodium Sulfite | 4.0 g |
| Ammonium Thiosulfate (70 wt % aq. soln.) | 175.0 ml |

-continued

| | |
|---|---|
| Sodium Bisulfite | 4.6 g |
| Water to make | 1 l |
| Stabilizing Solution | |
| Formaldehyde (38 wt % aq. soln.) | 8.0 ml |
| Water to make | 1 l |

The resulting strips were subjected to measurement using a P-type densitometer made by Fuji Photo Film Co., Ltd. to obtain the minus blue sensitivity ($S_Y$). The standard point of the optical density to determine the sensitivity was (fog +0.20). The results obtained are shown as relative values in Tables 8 to 10 below.

TABLE 8

| Run No. | Sensitizing Dye and Amount Used × $10^{-5}$ mol | | | | 20°-25° C. 50-60% RH | | 50° C. 20% RH | | 50° C. 80% RH | |
|---|---|---|---|---|---|---|---|---|---|---|
| | | | | | $S_Y$ | Fog | $S_Y$ | Fog | $S_Y$ | Fog |
| 36 | | — | | — | — | 0.10 | — | 0.15 | — | 0.17 |
| 37 | (I-1) | 3 | (II-15) | 10 | 100 | 0.10 | 102 | 0.15 | 100 | 0.16 |
| 38 | (I-1) | 6 | (II-15) | 10 | 104 | 0.10 | 108 | 0.15 | 100 | 0.16 |
| 39 | (I-1) | 12 | (II-15) | 10 | 92 | 0.11 | 97 | 0.16 | 89 | 0.17 |
| 40 | (B) (for comparison) | 3 | (II-15) | 10 | 106 | 0.10 | 111 | 0.18 | 96 | 0.19 |
| 41 | (B) (for comparison) | 6 | (II-15) | 10 | 106 | 0.10 | 114 | 0.18 | 98 | 0.19 |
| 42 | (B) (for comparison) | 12 | (II-15) | 10 | 89 | 0.12 | 91 | 0.20 | 79 | 0.22 |

TABLE 9

| Run No. | Sensitizing Dye and Amount Used × $10^{-5}$ mol | | | | 20°-25° C. 50-60% RH | | 50° C. 20% RH | | 50° C. 80% RH | |
|---|---|---|---|---|---|---|---|---|---|---|
| | | | | | $S_Y$ | Fog | $S_Y$ | Fog | $S_Y$ | Fog |
| 43 | | — | | — | — | 0.10 | — | 0.15 | — | 0.17 |
| 44 | (I-2) | 3 | (II-16) | 10 | 100 | 0.10 | 100 | 0.14 | 97 | 0.16 |
| 45 | (I-2) | 6 | (II-16) | 10 | 100 | 0.10 | 103 | 0.14 | 97 | 0.16 |
| 46 | (I-2) | 12 | (II-16) | 10 | 89 | 0.11 | 92 | 0.15 | 85 | 0.17 |
| 47 | (B) (for comparison) | 3 | (II-16) | 10 | 104 | 0.10 | 111 | 0.18 | 93 | 0.20 |
| 48 | (B) (for comparison) | 6 | (II-16) | 10 | 100 | 0.10 | 108 | 0.18 | 90 | 0.21 |
| 49 | (B) (for comparison) | 12 | (II-16) | 10 | 86 | 0.11 | 91 | 0.21 | 76 | 0.24 |

TABLE 10

| Run No. | Sensitizing Dye and Amount Used × $10^{-5}$ mol | | | | 20°-25° C. 50-60% RH | | 50° C. 20% RH | | 50° C. 80% RH | |
|---|---|---|---|---|---|---|---|---|---|---|
| | | | | | $S_Y$ | Fog | $S_Y$ | Fog | $S_Y$ | Fog |
| 50 | | — | | — | — | 0.10 | — | 0.15 | — | 0.17 |
| 51 | (I-3) | 3 | (II-14) | 10 | 100 | 0.10 | 105 | 0.15 | 94 | 0.16 |
| 52 | (I-3) | 6 | (II-14) | 10 | 104 | 0.10 | 109 | 0.15 | 100 | 0.16 |
| 53 | (I-3) | 12 | (II-14) | 10 | 94 | 0.11 | 97 | 0.15 | 94 | 0.17 |
| 54 | (B) (for comparison) | 3 | (II-14) | 10 | 96 | 0.10 | 101 | 0.18 | 87 | 0.20 |
| 55 | (B) (for comparison) | 6 | (II-14) | 10 | 96 | 0.10 | 104 | 0.19 | 85 | 0.20 |
| 56 | (B) (for | 12 | (II-14) | 10 | 85 | 0.11 | 93 | 0.23 | 76 | 0.24 |

TABLE 10-continued

| Run No. | Sensitizing Dye and Amount Used × $10^{-5}$ mol | 20°-25° C. 50-60% RH Sγ | Fog | 50° C. 20% RH Sγ | Fog | 50° C. 80% RH Sγ | Fog |
|---|---|---|---|---|---|---|---|
| | compar-ison) | | | | | | |

The structural formula of Dye (B) for comparison in this example is shown in Example 3.

Tables 3 to 7 show the results obtained from testing the storage properties of samples which were prepared using the sensitizing dyes of the present invention, and sensitizing dye (B) employed for comparison with using a cyan coupler. Tables 8 to 10 show similar results using a magenta coupler. Comparing the sensitizing dyes of the present invention with the sensitizing dye (B) for comparison, it can be understood that no or only a slight increase in fog occurs in the light-sensitive materials containing the dyes of the present invention even when the light-sensitive materials were allowed to stand under severe conditions. Further, only a small variation in sensitivity occurs in the light-sensitive materials containing the dyes of the present invention even when the sensitive materials were allowed to stand under the condition of high humidity, in comparison with the results of the light-sensitive material containing sensitizing dye (B) for comparison. For example, comparing the sensitivities under conditions of 50° C., 80% RH and 20° to 25° C., 50 to 60% RH in Table 3 Run Nos. 2, 3 and 4 (the present invention) and Run Nos. 5, 6 and 7 (for comparison), the decrease in the sensitivity was 0% (Run No. 2), 3% (Run No. 3) and 3% (Run No. 4) for the present invention but the decrease in the sensitivity was 6.5% (Run No. 5), 67% (Run No. 6) and 10% (Run No. 7) for the comparison.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in supersensitizing amounts, a combination of at least one benzimidazolocarbocyanine dye wherein an aralkyl group substituted with an acidic group is connected to at least one nitrogen atom in the imidazole ring, which is represented by the following general formula (I-B)

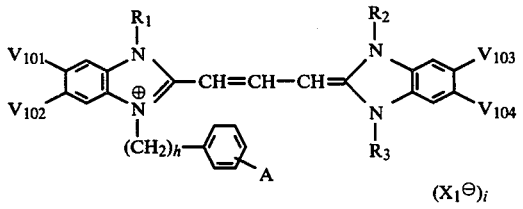

(I-B)

wherein $V_{101}$, $V_{102}$, $V_{103}$ and $V_{104}$, which may be the same or different, each represents a hyrogen atom, a halogen atom, an alkyl group, an alkenyl group, a cycloalkyl group, an acyl group, an acyloxy group, an alkoxycarbonyl group, a carbamoyl group, a sulfamoyl group, a cyano group, a trifluoromethyl group or a hydroxy group, with the proviso that at least one of $V_{101}$ and $V_{102}$, and $V_{103}$ and $V_{104}$, represents simultaneously a chlorine atom; $R_1$, $R_2$ and $R_3$, which may be the same or different, each represents an aliphatic group, with the proviso that $R_3$ can also be a substituted alkyl group; A represents a sulfo group or a carboxy group; $X_1$ represents an acid residue; h represents an integer from 1 to 6; and i represents 0 or 1;

at least one cyanine dye represented by the following general formula (II):

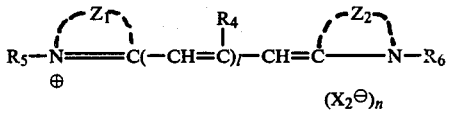

(II)

wherein $Z_1$ and $Z_2$ are selected from one of the following combinations (A)-(E):

(A) $Z_1$ represents the atoms necessary to complete a naphthothiazole nucleus, and $Z_2$ represents the atoms necessary to complete a benzothiazole or a naphthothiazole nucleus;

(B) $Z_1$ represents the atoms necessary to complete a benzothiazole nucleus, and $Z_2$ represents the atoms necessary to complete a benzoxazole nucleus;

(C) $Z_1$ represents the atoms necessary to complete a benzothiazole nucleus, and $Z_2$ represents the atoms necessary to complete a naphthoxazole nucleus;

(D) $Z_1$ represents the atoms necessary to complete a naphthothiazole nucleus, and $Z_2$ represents the atoms necessaty to complete a benzoxazole nucleus;

(E) $Z_1$ represents the atoms necessary to complete a naphthothiazole nucleus, and $Z_2$ represents the atoms necessary to complete a naphthoxazole nucleus, wherein a heterocyclic nucleus and/or a benzene nucleus, present in a naphthothiazole or naphthoxaxole group, may be substituted with one or more substituents selected from the group consisting of an alkyl group containing 6 or less carbon atoms, an alkenyl group containing 6 or less carbon atoms, a cycloalkyl group containing 6 or less carbon atoms, an aryl group, which may be mono- or bicyclic, a hydroxy group, an alkoxy group containing 7 or less carbon atoms, an acyl group containing 8 or less carbon atoms, a carboxy group, an alkoxycarbonyl group containing 8 or less carbon atoms, or a halogen atom; $R_4$ represents a hydrogen atom, an aliphatic group or an aryl group; $R_5$ and $R_6$, which may be the same or different, each represents an aliphatic group; $X_2$ represents an acid residue; and l represents 1 and n represents 0 or 1.

2. The silver halide photographic emulsion as described in claim 1, wherein $Z_1$ represents the atoms necessary to complete a naphthothiazole nucleus; and $Z_2$ represents the atoms necessary to complete a benzothiazole nucleus or a naphthothiazole nucleus.

3. The silver halide photographic emulsion as described in claim 1, wherein $Z_1$ represents the atoms necessary to complete a benzothiazole nucleus; and $Z_2$ represents the atoms necessary to complete a benzoxazole nucleus.

4. The silver halide photographic emulsion as described in claim 1, wherein $Z_1$ represents the atoms necessary to complete a benzothiazole nucleus; and $Z_2$ represents the atoms necessary to complete a naphthoxazole nucleus.

5. The silver halide photographic emulsion as described in claim 1, wherein $Z_1$ represents the atoms necessary to complete a naphthothiazole nucleus; and $Z_2$ represents the atoms necessary to complete a benzoxazole nucleus.

6. The silver halide photographic emulsion as described in claim 1, wherein $Z_1$ represents the atoms necessary to complete a naphthothiazole nucleus; and $Z_2$ represents the atoms necessary to complete a nphthoxazole nucleus.

7. The silver halide photographic emulsion as described in claim 1, wherein $Z_1$ represents the atoms necessary to complete a benzothiazole nucleus which is substituted at the 5-position with a halogen atom, an alkoxy group, an alkyl group or a phenyl group and $Z_2$ represents the atoms necessary to complete a benzoxazole nucleus which is substituted at the 5-position with a halogen atom, an alkoxy group, an alkyl group or a phenyl group.

* * * * *